US009199827B2

(12) United States Patent
Ku et al.

(10) Patent No.: US 9,199,827 B2
(45) Date of Patent: Dec. 1, 2015

(54) OVERHEAD TRAVELLING CRANE SYSTEM

(71) Applicant: FALCON MACHINE TOOLS CO., LTD., Taichung (TW)

(72) Inventors: Ming-Che Ku, Taichung (TW); Tzu-Lin Chen, Changhua County (TW)

(73) Assignee: Falcon Machine Tools Co., Ltd., Taichung (TW)

( * ) Notice: Subject to any disclaimer, the term of this patent is extended or adjusted under 35 U.S.C. 154(b) by 16 days.

(21) Appl. No.: 14/201,988

(22) Filed: Mar. 10, 2014

(65) Prior Publication Data

US 2015/0251880 A1 Sep. 10, 2015

(51) Int. Cl.

| | |
|---|---|
| ***B66C 1/44*** | (2006.01) |
| ***B66C 19/00*** | (2006.01) |
| ***B66C 17/04*** | (2006.01) |
| ***B66C 17/00*** | (2006.01) |
| ***B66C 1/42*** | (2006.01) |

(52) U.S. Cl.

CPC ..... *B66C 19/00* (2013.01); *B66C 1/427* (2013.01); *B66C 1/447* (2013.01); *B66C 17/00* (2013.01); *B66C 17/04* (2013.01)

(58) Field of Classification Search

CPC ..... B66C 17/00; B66C 17/04; B66C 1/447; B66C 1/427

See application file for complete search history.

(56) References Cited

U.S. PATENT DOCUMENTS

| | | | | | |
|---|---|---|---|---|---|
| 3,679,071 | A * | 7/1972 | Smith | 414/10 |
| 4,289,076 | A * | 9/1981 | Miller | 105/163.1 |
| 4,599,774 | A * | 7/1986 | Till, Jr. | 29/726 |
| 4,609,323 | A * | 9/1986 | Blaseck et al. | 414/663 |
| 4,832,902 | A * | 5/1989 | Kaufmann et al. | 376/268 |
| 4,927,595 | A * | 5/1990 | Kaufmann et al. | 376/268 |
| 5,865,426 | A * | 2/1999 | Kazerooni | 415/5 |
| 5,915,673 | A * | 6/1999 | Kazerooni | 414/5 |
| 8,602,473 | B2 * | 12/2013 | Weber | 294/207 |
| 2002/0144970 | A1 * | 10/2002 | Seith | 212/285 |
| 2004/0115035 | A1 * | 6/2004 | Tygard | 414/621 |
| 2004/0258513 | A1 * | 12/2004 | Cooke | 414/626 |
| 2009/0123255 | A1 * | 5/2009 | Waisanen | 414/146 |
| 2009/0309379 | A1 * | 12/2009 | Hwang | 294/104 |
| 2010/0201143 | A1 * | 8/2010 | Ehnes et al. | 901/31 |
| 2010/0243592 | A1 * | 9/2010 | Ko | 212/203 |

* cited by examiner

*Primary Examiner* — Gerald McClain

(74) *Attorney, Agent, or Firm* — Alan D. Kamrath; Kamrath IP Lawfirm, P.A.

(57) ABSTRACT

An overhead travelling crane system includes a conveyor device, and two clamping devices connected with the conveyor device. The conveyor device includes two lifting units and a traversing unit connected with the lifting units. When in use, each of the clamping devices is moved upward or downward by operation of each of the lifting units of the conveyor device, and is moved leftward or rightward by operation of the traversing unit of the conveyor device. In addition, each of the clamping devices is extended outward to clamp the wheel rim or retracted inward to loosen the wheel rim.

5 Claims, 7 Drawing Sheets

OVERHEAD TRAVELLING CRANE SYSTEM

BACKGROUND OF THE INVENTION

1. Field of the Invention

The present invention relates to an overhead travelling crane system and, more particularly, to an overhead travelling crane system for driving a wheel rim.

2. Description of the Related Art

When a wheel rim is worked, the ear on one side of the wheel rim is clamped. Then, the ear on the other side of the wheel rim proceeds an inner and outer diameter working process (OP1). Then, the ear on the other side of the wheel rim is clamped after the OP1 is finished, and proceeds a disk surface working process (OP2). Then, the wheel rim is turned through a determined angle to proceed an air nozzle working process (OP3). Finally, the working procedure of the wheel rim is accomplished after the OP3 is finished. An overhead travelling crane system is used to carry, clamp and turn the wheel rim which has a heavy weight. A conventional overhead travelling crane system comprises an oil cylinder to lift and lower the wheel rim. However, the oil cylinder easily fails due to a frequent displacement of the wheel rim. In addition, the oil cylinder has a high cost of maintenance.

BRIEF SUMMARY OF THE INVENTION

The primary objective of the present invention is to provide an overhead travelling crane system that is driven to lift and lower, to move transversely, and to perform a clamping action to a wheel rim when the wheel rim is worked.

In accordance with the present invention, there is provided an overhead travelling crane system comprising a conveyor device, and two clamping devices connected with the conveyor device. The conveyor device includes two lifting units and a traversing unit connected with the lifting units. Each of the lifting units includes a first power mechanism, a lifting base having an upper end and lower end each provided with at least one sensor, a toothed rack secured on a first face of the lifting base and engaging the first power mechanism, and two rails each secured on a second face of the lifting base and each slidably mounted on at least one guide block which is affixed to the first power mechanism. The traversing unit includes a first transmission mechanism connected with the first power mechanism of each of the lifting units, and a second power mechanism connected with the first transmission mechanism. The first transmission mechanism includes a transverse base, and a press board corresponding to the transverse base. Each of the clamping devices includes a carrier, an actuating mechanism mounted on the carrier, a holding mechanism connected with the actuating mechanism, a second transmission mechanism mounted on the carrier and connected with the holding mechanism, a second power mechanism mounted on the second transmission mechanism and connected with the holding mechanism, and a detection mechanism mounted on the carrier. The carrier includes a bottom plate, two side plates mounted on the bottom plate, and a receiving chamber defined between the bottom plate and the side plates. The actuating mechanism includes two guide track modules mounted on the bottom plate of the carrier. The holding mechanism includes two retaining modules mounted on the guide track modules of the actuating mechanism. The second transmission mechanism includes a mounting board mounted on the side plates of the carrier, and a transmission module pivotally mounted on the mounting board and engaging each of the retaining modules. The second power mechanism includes a fixing board mounted on the mounting board of the second transmission mechanism, a pneumatic cylinder mounted on the fixing board and connected with one of the retaining modules of the holding mechanism, and a plurality of sensors mounted on the fixing board. The detection mechanism includes two detector modules and respectively mounted on the side plates of the carrier, and a sensing module connected with the detector modules.

When in use, the lifting base of each of the lifting units is moved upward or downward so that each of the clamping devices is driven by each of the lifting units of the conveyor device to move upward or downward relative to a wheel rim. When the traversing unit is moved leftward or rightward, the lifting base of each of the lifting units is moved leftward or rightward, so that each of the clamping devices is also moved leftward or rightward relative to the wheel rim. Thus, each of the clamping devices is moved upward or downward by operation of each of the lifting units of the conveyor device, and is moved leftward or rightward by operation of the traversing unit of the conveyor device. In addition, each of the clamping devices is extended outward to clamp the wheel rim or retracted inward to loosen the wheel rim.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
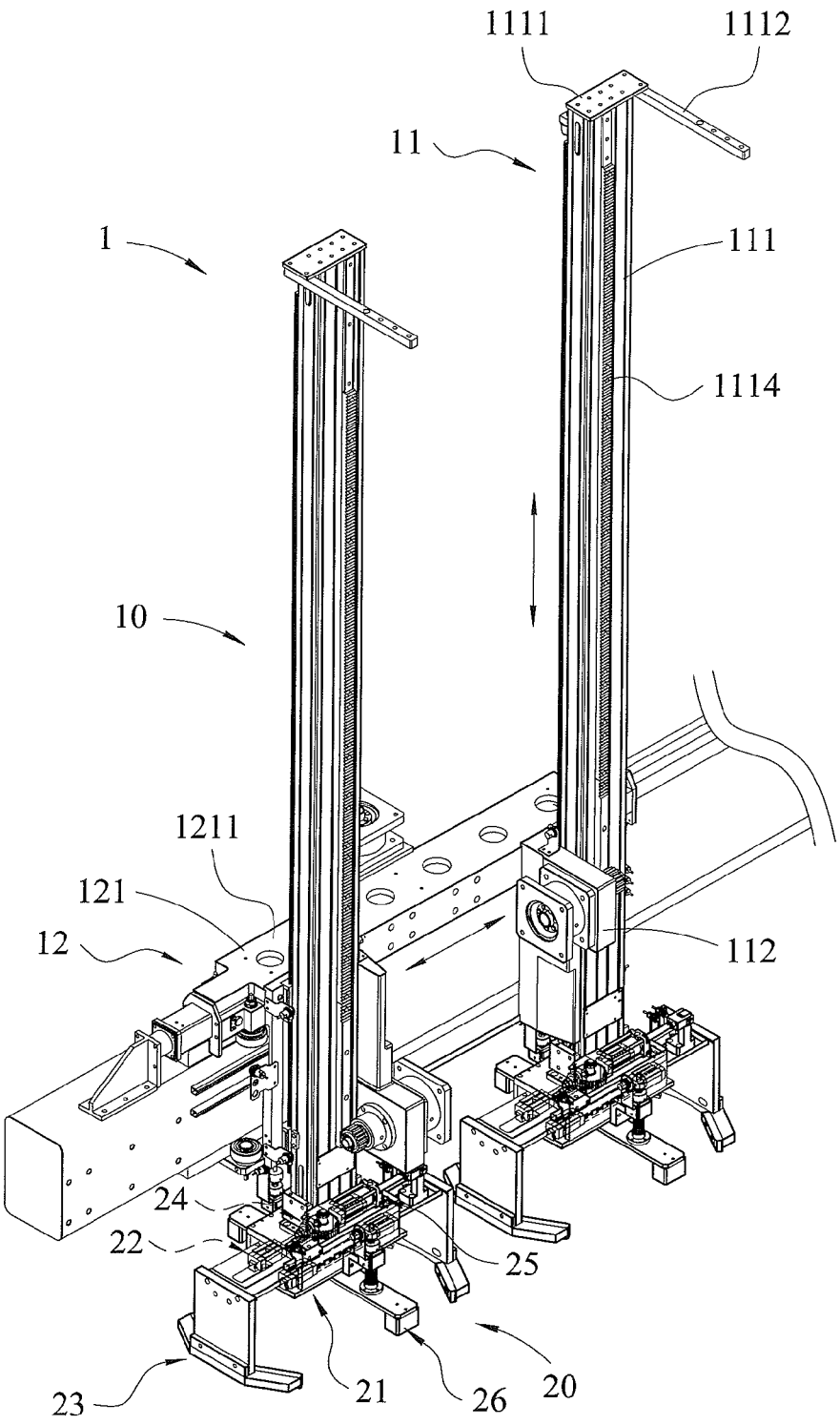
FIG. 1 is a perspective view of an overhead travelling crane system in accordance with the preferred embodiment of the present invention.
Figure 2:
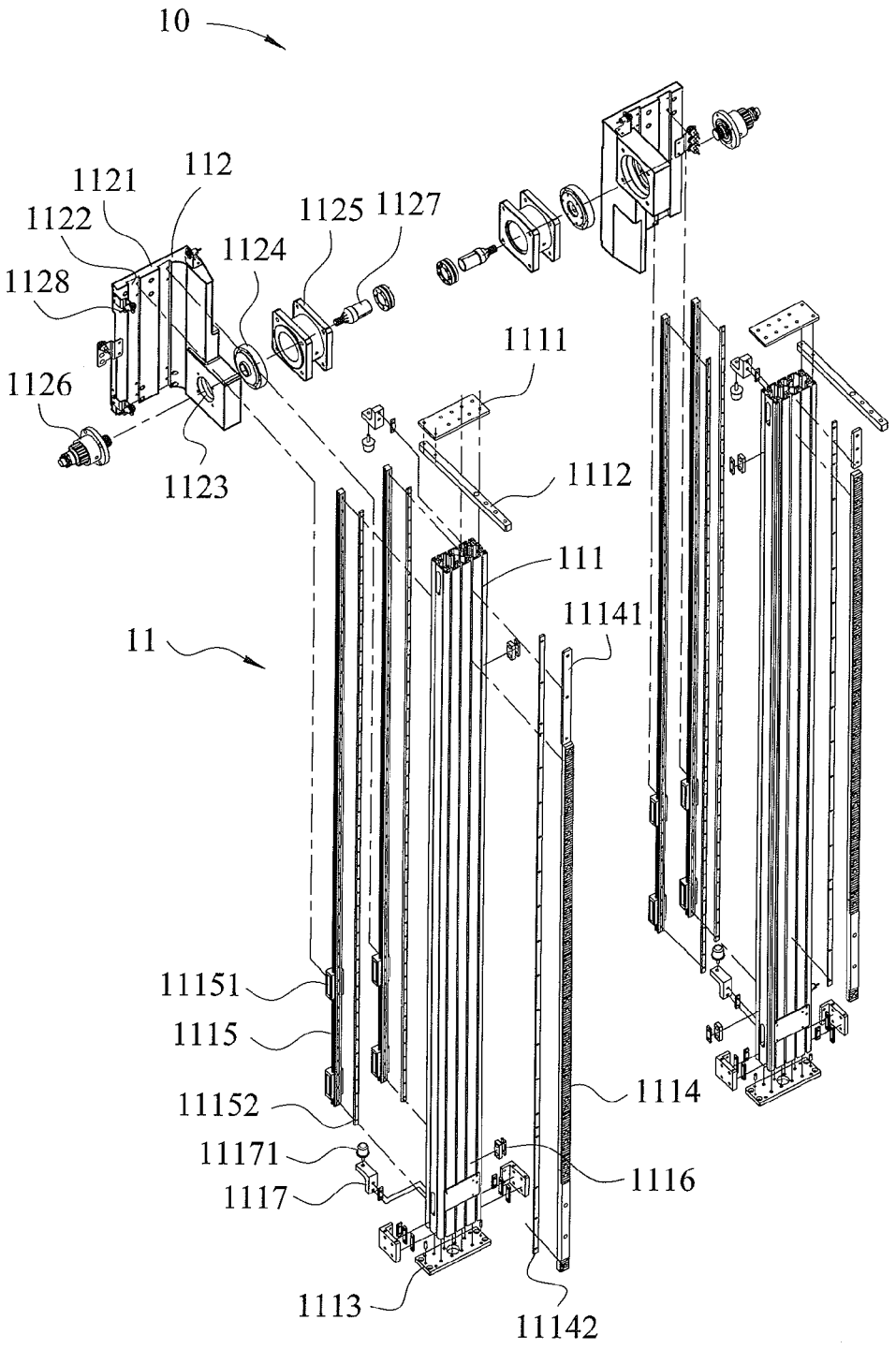
FIG. 2 is an exploded perspective view of a lifting unit of a conveyor device of the overhead travelling crane system as shown in FIG. 1.
Figure 3:
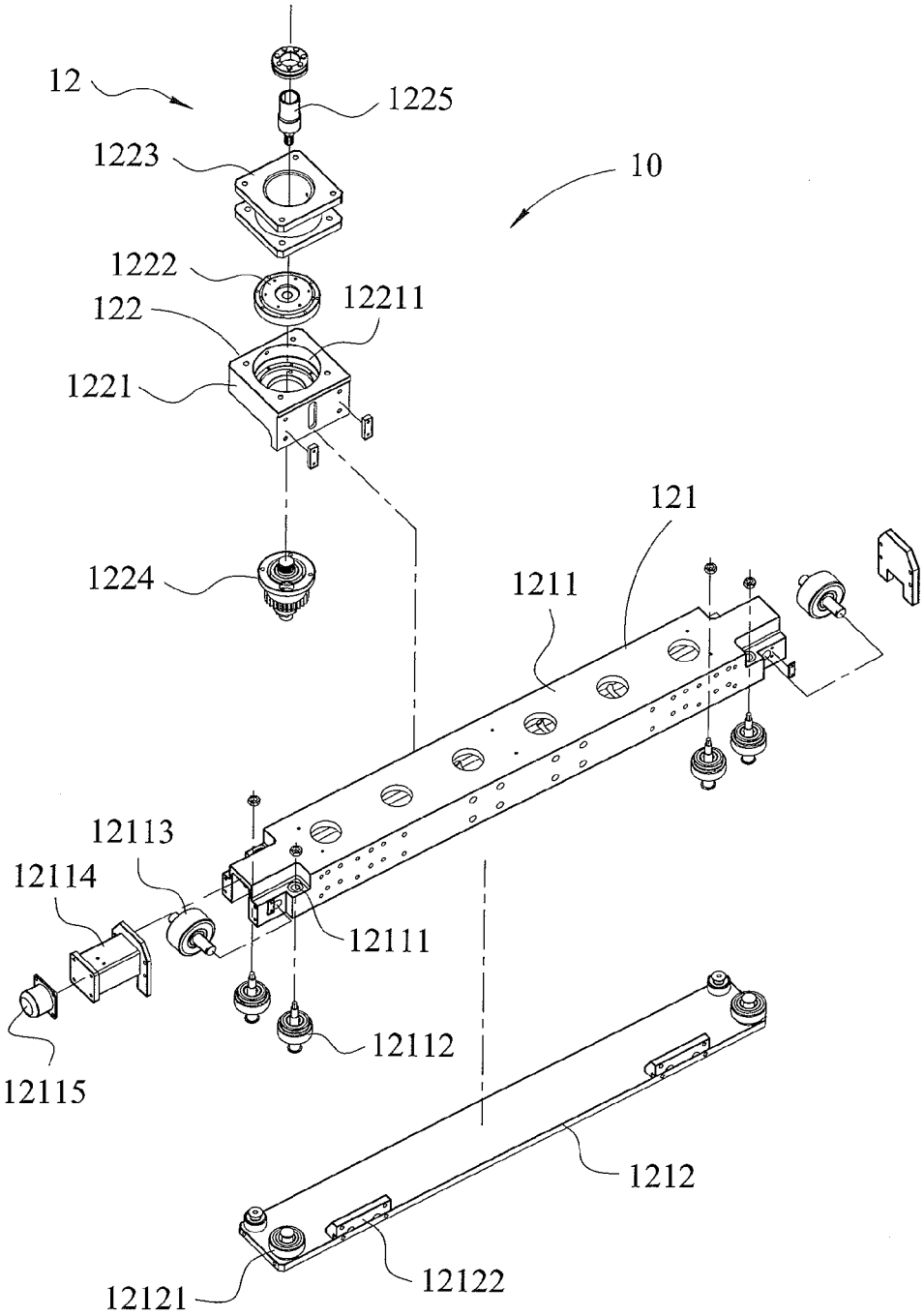
FIG. 3 is an exploded perspective view of a traversing unit of the conveyor device of the overhead travelling crane system as shown in FIG. 1.
Figure 4:
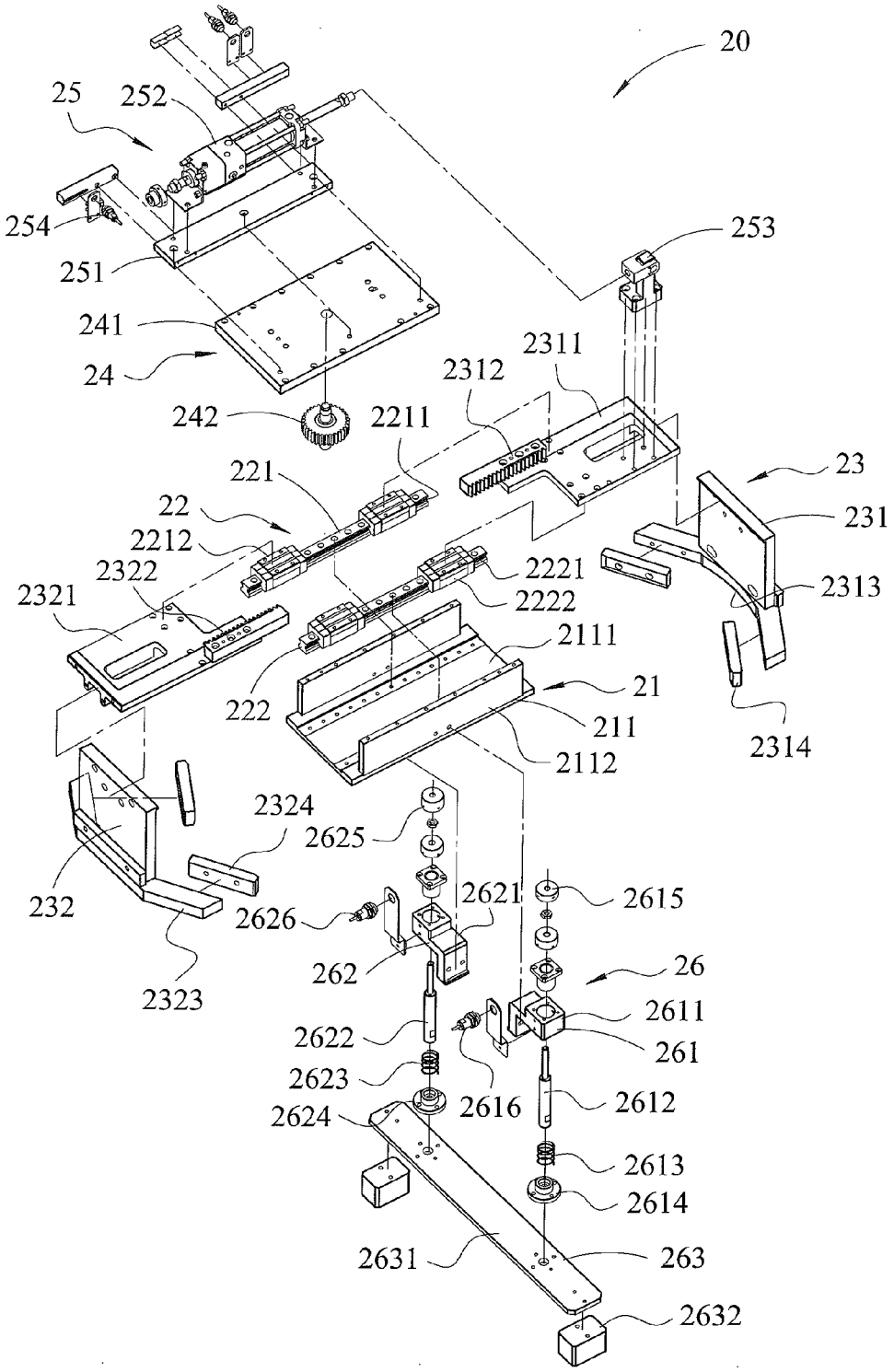
FIG. 4 is an exploded perspective view of a clamping device of the overhead travelling crane system as shown in FIG. 1.

Referring to the drawings and initially to FIGS. 1-4, an overhead travelling crane system 1 in accordance with the preferred embodiment of the present invention comprises a conveyor device 10, and two clamping devices 20 connected with the conveyor device 10.

The conveyor device 10 includes two lifting units 11 and a traversing unit 12 connected with the lifting units 11.

Each of the lifting units 11 includes a first power mechanism 112, a lifting base 111 having an upper end and lower end each provided with at least one sensor 1116, a toothed rack 1114 secured on a first face of the lifting base 111 and engaging the first power mechanism 112, and two rails 1115 each secured on a second face of the lifting base 111 and each slidably mounted on at least one guide block 11151 which is affixed to the first power mechanism 112. The lifting base 111 is made of aluminum extrusion.

Each of the lifting units 11 further includes a fixing plate 1111 mounted on the upper end of the lifting base 111, a dividing block 1112 mounted on the fixing plate 1111, a connecting board 1113 mounted on the lower end of the lifting base 111, a catch plate 11141 mounted on the toothed rack 1114, a pressing plate 11142 mounted between the toothed rack 1114 and the lifting base 111 to enhance the tightness between the toothed rack 1114 and the lifting base 111, two pressing plates 11152 mounted between the rails 1115 and the lifting base 111 to enhance the tightness between the rails 1115 and the lifting base 111, two bumpers 1117 mounted on the lifting base 111, and two brakes 11171 mounted on the lifting base 111 to reduce the speed of the lifting base 111 when the lifting base 111 is moved upward and downward.

The first power mechanism 112 includes a mounting seat 1121, a reducer 1124 mounted on the mounting seat 1121, an abutment 1125 mounted on the mounting seat 1121 and abutting the reducer 1124, a drive shaft 1127 connected with the reducer 1124, a driving module 1126 connected with the reducer 1124 and engaging the toothed rack 1114, and a sensor 1128 mounted on the mounting seat 1121. The mounting seat 1121 has a substantially L-shaped profile. The mounting seat 1121 is provided with two fixing channels 1122 for receiving and locking the guide block 11151 on each of the two rails 1115. The mounting seat 1121 is provided with a receiving recess 1123 for receiving the reducer 1124. The driving module 1126 is preferably a gear meshing with the toothed rack 1114 of the lifting base 111 so that when the driving module 1126 is rotated, the lifting base 111 is moved upward or downward relative to the mounting seat 1121. The sensor 1128 is preferably a proximity switch.

The traversing unit 12 includes a first transmission mechanism 121 connected with the first power mechanism 112 of each of the lifting units 11, and a second power mechanism 122 connected with the first transmission mechanism 121.

The first transmission mechanism 121 includes a transverse base 1211, and a press board 1212 corresponding to the transverse base 1211. The transverse base 1211 is affixed to the mounting seat 1121 of each of the lifting units 11 and has two opposite ends each provided with two roller sets 12112 and a castor set 12113. The transverse base 1211 is provided with a plurality of pivot holes 12111 for mounting the roller sets 12112. Each of the two opposite ends of the transverse base 1211 has a substantially inverted U-shaped profile. One of the two opposite ends of the transverse base 1211 is provided with a bumper 12114 and a buffer pad 12115. The press board 1212 is located under the transverse base 1211. The press board 1212 is affixed to the mounting seat 1121 of each of the lifting units 11 and has two opposite ends each provided with a roller set 12121. The press board 1212 is provided with two fixing blocks 12122 each secured on the mounting seat 1121 of each of the lifting units 11.

The second power mechanism 122 includes a fixed seat 1221 secured on the transverse base 1211, a reducer 1222 mounted on the fixed seat 1221, an abutment 1223 mounted on the fixed seat 1221 and abutting the reducer 1222, a drive shaft 1225 connected with the reducer 1222, and a driving module 1224 connected with the reducer 1222. The fixed seat 1221 is provided with a receiving recess 12211 for receiving the reducer 1222. The driving module 1224 is preferably a gear.

Each of the clamping devices 20 is secured on the connecting board 1113 of each of the lifting units 11 to move in concert with each of the lifting units 11. The lifting units 11 are moved leftward or rightward by movement of the traversing unit 12 so that the clamping devices 20 are moved leftward or rightward by movement of the traversing unit 12.

Each of the clamping devices 20 includes a carrier 21, an actuating mechanism 22 mounted on the carrier 21, a holding mechanism 23 connected with the actuating mechanism 22, a second transmission mechanism 24 mounted on the carrier 21 and connected with the holding mechanism 23, a second power mechanism 25 mounted on the second transmission mechanism 24 and connected with the holding mechanism 23, and a detection mechanism 26 mounted on the carrier 21.

The carrier 21 includes a bottom plate 211, two side plates 2112 mounted on the bottom plate 211, and a receiving chamber 2111 defined between the bottom plate 211 and the side plates 2112.

The actuating mechanism 22 includes two guide track modules 221 and 222 mounted on the bottom plate 211 of the carrier 21 and located in the receiving chamber 2111 of the carrier 21, and two sliding blocks 2212 and 2222 slidably mounted on each of the guide track modules 221 and 222. Each of the guide track modules 221 and 222 has two opposite sides each provided with a track 2211 and 2221 for mounting each of the sliding blocks 2212 and 2222.

The holding mechanism 23 includes two retaining modules 231 and 232 mounted on the guide track modules 221 and 222 of the actuating mechanism 22. Each of the retaining modules 231 and 232 includes a linking board 2311 and 2321 secured on the sliding blocks 2212 and 2222 of the guide track modules 221 and 222, a guide rack 2312 and 2322 secured on the linking board 2311 and 2321, and a clamping claw 2313 and 2323 secured on the linking board 2311 and 2321. The guide rack 2312 and 2322 of each of the retaining modules 231 and 232 is preferably a toothed rack. The clamping claw 2313 and 2323 of each of the retaining modules 231 and 232 is provided with at least one clamping piece 2314 and 2324.

The second transmission mechanism 24 includes a mounting board 241 mounted on the side plates 2112 of the carrier 21, and a transmission module 242 pivotally mounted on the mounting board 241 and engaging each of the retaining modules 231 and 232. The mounting board 241 is located at the top of each of the side plates 2112 of the carrier 21. The mounting board 241 of each of the clamping devices 20 is secured on the connecting board 1113 of each of the lifting units 11, so that when each of the lifting units 11 is moved upward or downward, each of the clamping devices 20 is also moved upward or downward. The transmission module 242 is pivoted at the bottom of the mounting board 241. The transmission module 242 is preferably a gear and engages the guide rack 2312 and 2322 of each of the retaining modules 231 and 232.

The second power mechanism 25 includes a fixing board 251 mounted on the mounting board 241 of the second transmission mechanism 24, a pneumatic cylinder 252 mounted on the fixing board 251 and connected with one of the retaining modules 231 and 232 of the holding mechanism 23, a connecting seat 253 secured on the linking board 2311 of one of the retaining modules 231 and 232 and connected with the pneumatic cylinder 252, and a plurality of sensors 254 mounted on the fixing board 251.

The detection mechanism 26 includes two detector modules 261 and 262 respectively mounted on the side plates 2112 of the carrier 21, and a sensing module 263 connected with the detector modules 261 and 262. Each of the detector modules 261 and 262 includes a fixing bracket 2611 and 2621 secured on each of the side plates 2112 of the carrier 21, a spindle 2612 and 2622 mounted on the fixing bracket 2611 and 2621, a resting member 2614 and 2624 mounted on the fixing bracket 2611 and 2621, an elastic member 2613 and 2623 mounted on the spindle 2612 and 2622 and biased between the fixing bracket 2611 and 2621 and the resting member 2614 and 2624, a detector 2615 and 2625 mounted on a top of the fixing bracket 2611 and 2621, and a sensing member 2616 and 2626 mounted on a side of the fixing bracket 2611 and 2621. The sensing module 263 is mounted on the bottom of each of the detector modules 261 and 262 and includes a press plate 2631 screwed onto the resting member 2614 and 2624 of each of the detector modules 261 and 262, and two sensing blocks 2632 mounted on the bottom of the press plate 2631.

Figure 6:
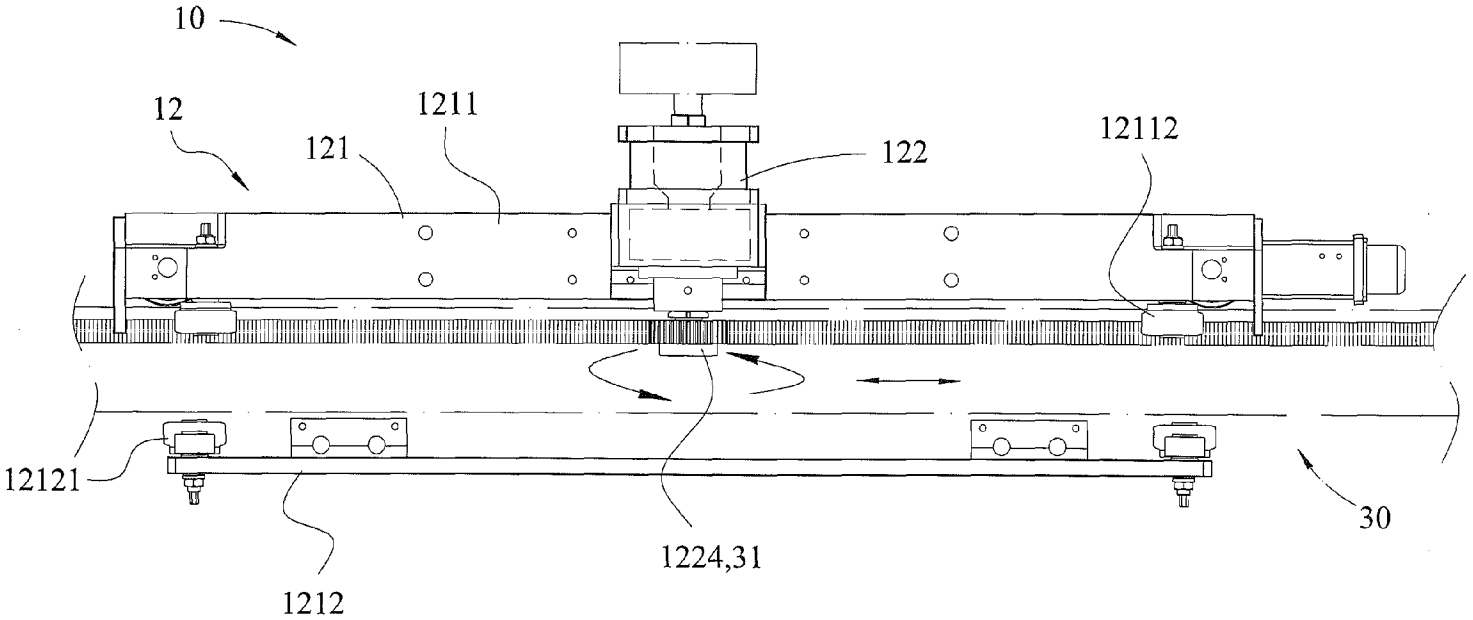
FIG. 6 is a schematic operational view showing a traversing motion of the conveyor device of the overhead travelling crane system as shown in FIG. 1.

In assembly, referring to FIG. 6 with reference to FIGS. 1-4, the traversing unit 12 is connected with a delivery track 30, with the transverse base 1211 of the first transmission mechanism 121 of the traversing unit 12 being above the delivery track 30, and the press board 1212 of the first transmission mechanism 121 of the traversing unit 12 being under the delivery track 30. At this time, the mounting seat 1121 of the first power mechanism 112 of each of the lifting units 11 is combined with the transverse base 1211 and the press board 1212 of the first transmission mechanism 121 of the traversing unit 12, so that the mounting seat 1121 of the first power mechanism 112 of each of the lifting units 11 is attached to the delivery track 30. The delivery track 30 includes a toothed rack 31 engaging the driving module 1224 of the second power mechanism 122 of the traversing unit 12.

Figure 5:
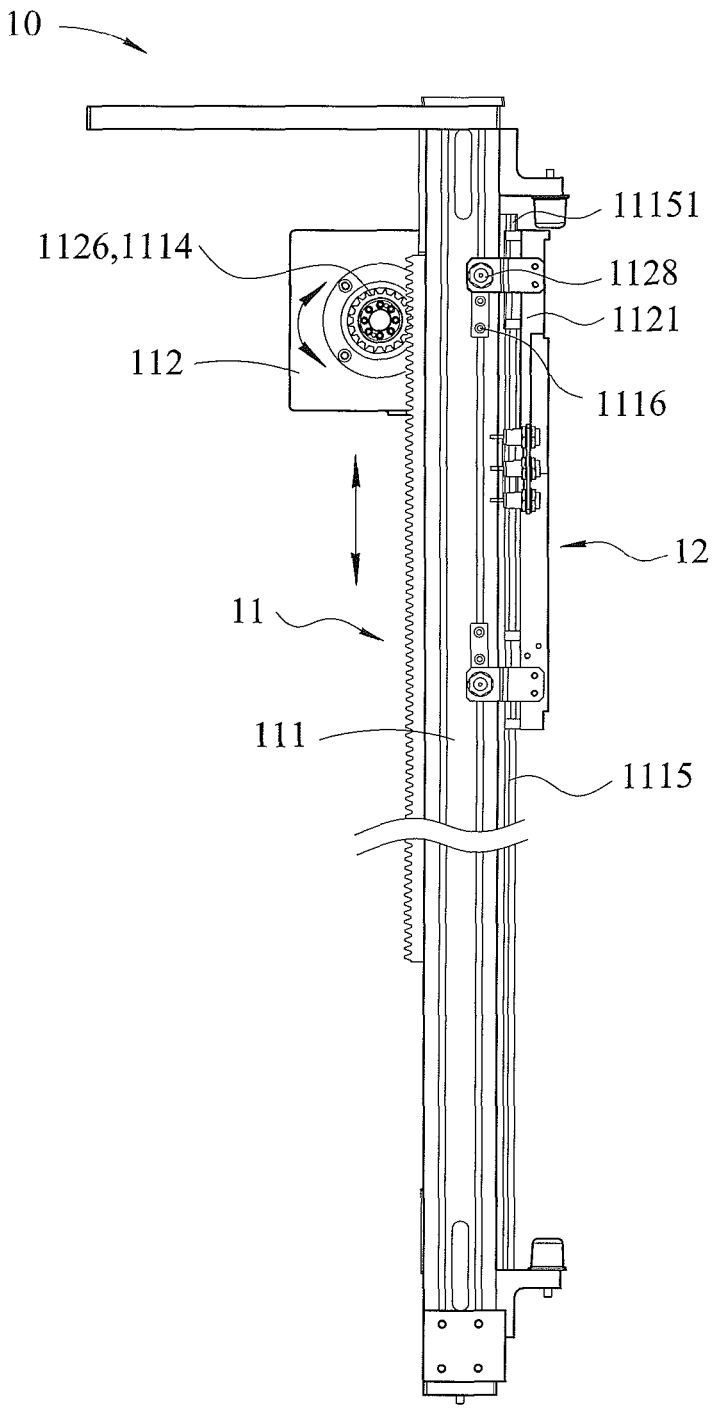
FIG. 5 is a schematic operational view showing a lifting motion of the conveyor device of the overhead travelling crane system as shown in FIG. 1.
Figure 7:
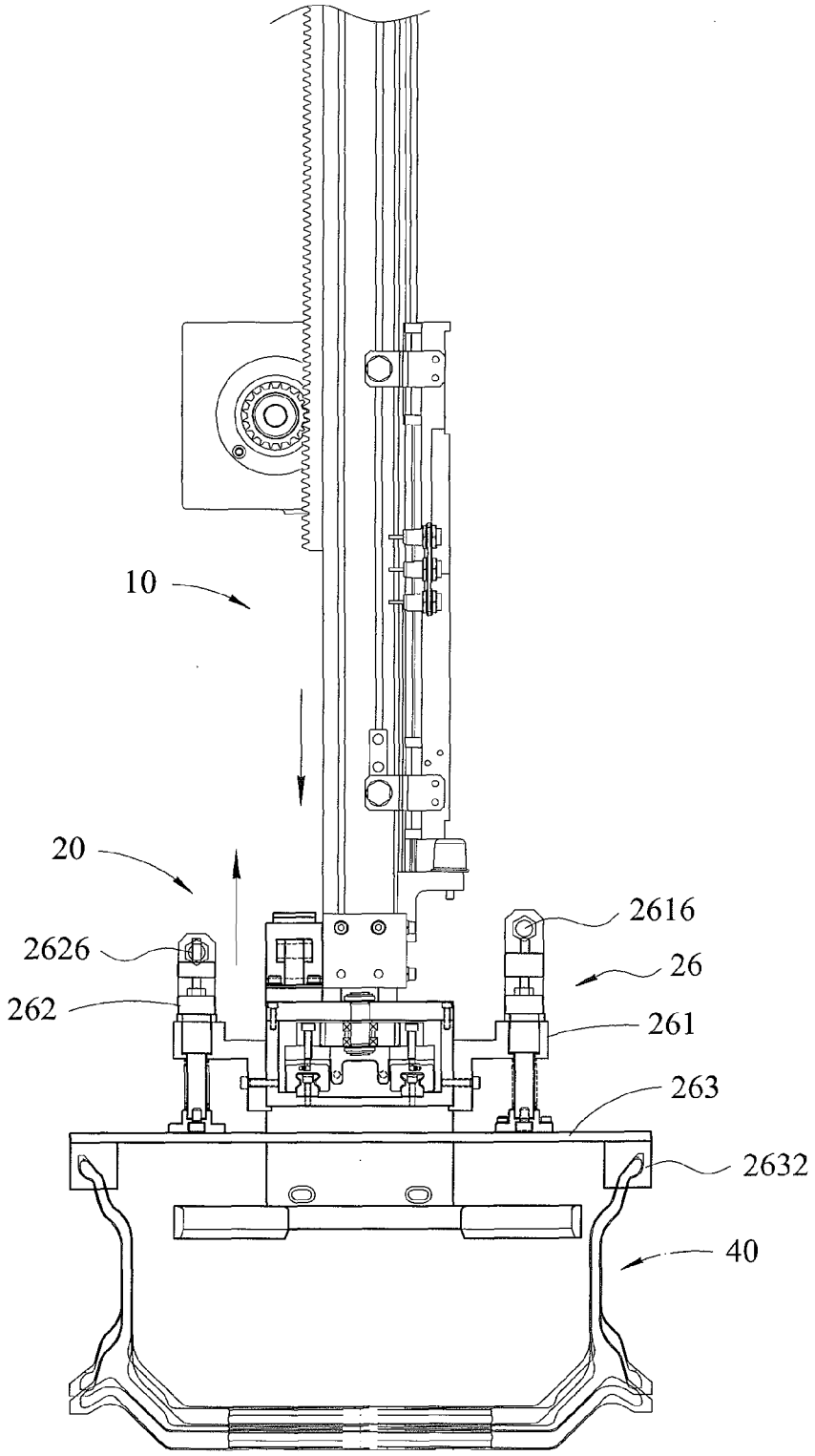
FIG. 7 is a schematic operational view showing a lifting motion of the clamping device of the overhead travelling crane system as shown in FIG. 1.

In operation, referring to FIGS. 5-7 with reference to FIGS. 1-4, the drive shaft 1127 of the first power mechanism 112 is rotated by a motor (not shown) to drive the reducer 1124 which drives the driving module 1126 so that the driving module 1126 is rotated. At this time, the driving module 1126 engages the toothed rack 1114, so that when the driving module 1126 is rotated, the lifting base 111 of each of the lifting units 11 of the conveyor device 10 is moved upward or downward as shown in FIG. 5, and each of the clamping devices 20 is driven by the conveyor device 10 to move upward or downward relative to a wheel rim 40 as shown in FIG. 7. It is to be noted that, the sensors 1116 on the lifting base 111 and the sensor 1128 on the mounting seat 1121 of the first power mechanism 112 interact and sense mutually to start or stop motion of the lifting base 111 of each of the lifting units 11.

In addition, the drive shaft 1225 of the second power mechanism 122 of the traversing unit 12 is rotated by a motor (not shown) to drive the reducer 1222 which drives the driving module 1224 so that the driving module 1224 is rotated. At this time, the driving module 1224 of the second power mechanism 122 of the traversing unit 12 engages the toothed rack 31 of the delivery track 30, so that when the driving module 1224 is rotated, the transverse base 1211 and the press board 1212 of the first transmission mechanism 121 of the traversing unit 12 are moved leftward or rightward relative to the delivery track 30, and the traversing unit 12 is moved leftward or rightward as shown in FIG. 6. It is to be noted that, the roller sets 12112 of the transverse base 1211 and the roller set 12121 of the press board 1212 facilitate the transverse movement of the traversing unit 12. Thus, when the traversing unit 12 is moved leftward or rightward, the lifting base 111 of each of the lifting units 11 is moved leftward or rightward, and each of the clamping devices 20 is also moved leftward or rightward.

In addition, the sensors 254 of the second power mechanism 25 emit a signal to start the pneumatic cylinder 252 which is extended or retracted to move the linking board 2311 (or 2321) and the guide rack 2312 (or 2322) of one of the retaining modules 231 and 232 of the holding mechanism 23. At this time, the transmission module 242 of the second transmission mechanism 24 engages the guide rack 2312 and 2322 of each of the retaining modules 231 and 232. In such a manner, when the guide rack 2312 (or 2322) of one of the retaining modules 231 and 232 of the holding mechanism 23 is moved, both of the retaining modules 231 and 232 of the holding mechanism 23 are moved synchronously in two opposite directions, so that the retaining modules 231 and 232 of the holding mechanism 23 are linearly moved outward to clamp the wheel rim 40 or inward to release the wheel rim 40.

As shown in FIG. 7, when each of the clamping devices 20 is driven by the conveyor device 10 to move downward to hold the wheel rim 40, the sensing blocks 2632 of the sensing module 263 of the detection mechanism 26 abut an ear of the wheel rim 40. At this time, the sensing member 2616 and 2626 of one of the detector modules 261 and 262 senses and judges if the wheel rim 40 presses a located position, and the sensing member 2616 and 2626 of the other one of the detector modules 261 and 262 senses the position and height of the wheel rim 40, so that when the position or height of the wheel rim 40 is not correct, the detection mechanism 26 will emit an alarm sound to notify the user. In addition, the sensing blocks 2632 abut the ear of the wheel rim 40 to position the wheel rim 40 in place to enhance the precision of the detector modules 261 and 262.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An overhead travelling crane system comprising:

a conveyor device; and two clamping devices connected with the conveyor device; wherein:

the conveyor device includes:

two lifting units; and a traversing unit connected with the lifting units;

each of the lifting units includes:

a first power mechanism;

a lifting base having an upper end and lower end each provided with at least one sensor;

a toothed rack secured on a first face of the lifting base and engaging the first power mechanism; and two rails each secured on a second face of the lifting base and each slidably mounted on at least one guide block which is affixed to the first power mechanism;

the traversing unit includes:

a first transmission mechanism connected with the first power mechanism of each of the lifting units; and a second power mechanism connected with the first transmission mechanism;

the first transmission mechanism includes:

a transverse base; and a press board corresponding to the transverse base;

each of the clamping devices includes:

a carrier;

an actuating mechanism mounted on the carrier;

a holding mechanism connected with the actuating mechanism;

a second transmission mechanism mounted on the carrier and connected with the holding mechanism;

a second power mechanism mounted on the second transmission mechanism and connected with the holding mechanism; and a detection mechanism mounted on the carrier;
the carrier includes:
a bottom plate;
two side plates mounted on the bottom plate; and
a receiving chamber defined between the bottom plate and the side plates;
the actuating mechanism includes two guide track modules mounted on the bottom plate of the carrier;
the holding mechanism includes two retaining modules mounted on the guide track modules of the actuating mechanism;
the second transmission mechanism includes:
a mounting board mounted on the side plates of the carrier; and
a transmission module pivotally mounted on the mounting board and engaging each of the retaining modules;
the second power mechanism includes:
a fixing board mounted on the mounting board of the second transmission mechanism;
a pneumatic cylinder mounted on the fixing board and connected with one of the retaining modules of the holding mechanism; and
a plurality of sensors mounted on the fixing board;
the detection mechanism includes:
two detector modules respectively mounted on the side plates of the carrier; and
a sensing module connected with the detector modules.

2. The overhead travelling crane system of claim 1, wherein:
the first power mechanism includes:
a mounting seat;
a reducer mounted on the mounting seat;
an abutment mounted on the mounting seat and abutting the reducer;
a drive shaft connected with the reducer;
a driving module connected with the reducer and engaging the toothed rack; and
a sensor mounted on the mounting seat;
the mounting seat is provided with two fixing channels for receiving and locking the guide block on each of the two rails;
the mounting seat is provided with a receiving recess for receiving the reducer.

3. The overhead travelling crane system of claim 2, wherein:
the transverse base is affixed to the mounting seat of each of the lifting units and has two opposite ends each provided with two roller sets and a castor set;
the press board is affixed to the mounting seat of each of the lifting units and has two opposite ends each provided with a roller set;
the press board is provided with two fixing blocks each secured on the mounting seat of each of the lifting units;
the second power mechanism includes:
a fixed seat secured on the transverse base;
a reducer mounted on the fixed seat;
an abutment mounted on the fixed seat and abutting the reducer;
a drive shaft connected with the reducer; and
a driving module connected with the reducer;
the fixed seat is provided with a receiving recess for receiving the reducer.

4. The overhead travelling crane system of claim 1, wherein:
the actuating mechanism further includes two sliding blocks slidably mounted on each of the guide track modules;
each of the guide track modules has two opposite sides each provided with a track for mounting each of the sliding blocks;
each of the retaining modules includes:
a linking board secured on the sliding blocks of the guide track modules;
a guide rack secured on the linking board; and
a clamping claw secured on the linking board;
the transmission module engages the guide rack of each of the retaining modules;
the second power mechanism further includes a connecting seat secured on the linking board of one of the retaining modules and connected with the pneumatic cylinder.

5. The overhead travelling crane system of claim 1, wherein:
each of the detector modules includes:
a fixing bracket secured on each of the side plates of the carrier;
a spindle mounted on the fixing bracket;
a resting member mounted on the fixing bracket;
an elastic member mounted on the spindle and biased between the fixing bracket and the resting member;
a detector mounted on a top of the fixing bracket; and
a sensing member mounted on a side of the fixing bracket;
the sensing module is mounted on the bottom of each of the detector modules.

* * * * *